US009241584B1

(12) United States Patent
McHatet

(10) Patent No.: US 9,241,584 B1
(45) Date of Patent: Jan. 26, 2016

(54) MULTIFACETED MERCHANDISER

(71) Applicant: Hamid McHatet, Miami, FL (US)

(72) Inventor: Hamid McHatet, Miami, FL (US)

( * ) Notice: Subject to any disclaimer, the term of this patent is extended or adjusted under 35 U.S.C. 154(b) by 0 days.

(21) Appl. No.: 14/741,152

(22) Filed: Jun. 16, 2015

(51) Int. Cl.
*A47F 3/06* (2006.01)
*A47F 3/14* (2006.01)

(52) U.S. Cl.
CPC .... *A47F 3/06* (2013.01); *A47F 3/14* (2013.01)

(58) Field of Classification Search
CPC ..... A47F 3/10; A47F 5/02
USPC ..... 312/125, 135, 136, 197, 249.2, 249.7, 312/305; 206/88, 581, 570, 372, 373
See application file for complete search history.

(56) References Cited

U.S. PATENT DOCUMENTS 906,368 A * 12/1908 Barger ..... 312/135
2,334,839 A * 11/1943 Purchas ..... A47G 21/14 206/372
4,100,684 A * 7/1978 Berger ..... 434/417
D255,753 S * 7/1980 Hoffman ..... 206/373
4,753,495 A * 6/1988 Swink ..... 312/114
4,858,765 A * 8/1989 Nakamura ..... A45D 40/24 132/296
5,083,668 A * 1/1992 Bushey ..... 211/59.1
5,244,095 A * 9/1993 DeVoe ..... A47J 47/16 206/229
D395,801 S * 7/1998 Miller ..... D7/641
7,188,726 B2 * 3/2007 Lin ..... B25H 3/003 206/373
8,596,454 B1 * 12/2013 Carlson ..... E06C 7/14 182/129
8,596,458 B1 * 12/2013 Alcorn ..... A45C 11/008 206/229
8,875,884 B1 * 11/2014 Lee ..... B25H 3/04 206/1.5
2006/0091032 A1 * 5/2006 Tsai ..... A45C 13/28 206/373
2010/0236955 A1 * 9/2010 Lase ..... B60R 9/065 206/373

* cited by examiner

*Primary Examiner* — Matthew Ing
(74) *Attorney, Agent, or Firm* — Albert Bordas, P.A.

(57) ABSTRACT

A multifaceted merchandiser having a body and an internal cavity. A door is used for accessing the internal cavity. A dividing panel is formed with a first mounting surface facing towards the door. Mounting structures associated with the mounting surface are constructed and arranged as mounting magnets for affixing articles thereto. Mounting cavities are constructed and arranged for receiving a display hook. At least one bin has at least one magnetic material attached or associated therewith. The magnetic material attached is selected to provide a magnetic attraction and mate with the magnetic material mounting magnets.

12 Claims, 7 Drawing Sheets

MULTIFACETED MERCHANDISER

BACKGROUND OF THE INVENTION

1. Field of the Invention

The present invention relates to merchandisers, and more particularly, to a multifaceted merchandiser to display products.

2. Description of the Related Art

Retailers loose more than $33 billion annually due to inventory shrinkage that typically results from theft and misplacement. Reducing inventory shrinkage is an important store management issue that must be addressed to achieve and maintain a successful operation. In an effort to increase owner profits, retailers have a need for an easy, simple, and inexpensive multifaceted merchandiser to securely display products. Several merchandiser and product displays have been developed in the past. None of them, however, comprise or even suggest the novel features of the present invention.

SUMMARY OF THE INVENTION

In one embodiment, the instant invention is a multifaceted merchandiser, comprising:

A) a body having an internal cavity;

B) a door for accessing said internal cavity;

C) a dividing panel formed with a first mounting surface facing towards said door;

D) mounting structures associated with said mounting surface, said mounting structures constructed and arranged as mounting magnets for affixing articles thereto and mounting cavities constructed and arranged for receiving a display hook; and E) at least one bin having at least one magnetic material attached or associated therewith, said magnetic material attached is selected to provide a magnetic attraction and mate with said magnetic material mounting magnets.

In one embodiment, the body is formed of a plurality of body panels.

In one embodiment, the body is formed of a plurality of body panels that are transparent.

In one embodiment, the body is formed of a plurality of body panels that are a combination of transparent and translucent panels.

In one embodiment, the body is formed of a plurality of body panels that are a combination of transparent and opaque panels.

In one embodiment, the dividing panel mounting structures include mounting cavities formed within said dividing panel.

In one embodiment, the display bin constructed and arranged for mounting on said dividing panel into a fixed position upon said mounting structures.

In one embodiment, the display bin constructed and arranged for removably mounting on said dividing panel into a fixed position upon said mounting structures.

In one embodiment, the display bin has at least one magnetic material attached or associated therewith includes at least one metallic or ferrometallic material selected to mount said bin onto said mounting magnets. Attached, as understood, is physical attachment. "Associated therewith" includes, but is not limited to, forming the bin with magnetic material integral therewith.

In one embodiment, the display bin has at least one magnetic material attached or associated therewith includes at least one ferrous material selected to mount said bin onto said mounting magnets.

In one embodiment, the door is hingedly attached to the multifaceted merchandiser with a conventional barrel hinge.

In one embodiment, the door is hingedly attached to the multifaceted merchandiser with a living hinge. In one embodiment, the door includes a closing mechanism.

In one embodiment, the dividing panel mounting structures mounting cavities formed within said dividing panel receive a display hook.

In one embodiment, the invention further includes a swivel assembly positioned under said body.

In one embodiment, the invention further includes a second door, a second mounting surface facing said second door, a pair of mounting brackets constructed and arranged to mount parallel one to another and secure to said second mounting surface through a plurality of mounting bracket receiving cavities.

In one embodiment, the invention further includes a second door, a second mounting surface facing said second door, a pair of mounting brackets constructed and arranged to mount parallel one to another and secure to said second mounting surface through a plurality of mounting bracket receiving cavities, wherein said mounting brackets are positioned in an angular offset measured as an acute angle relative to said second mounting surface of about 20-70 degrees.

In one embodiment, the invention further includes a second door, a second mounting surface facing said second door, a pair of mounting brackets constructed and arranged to mount parallel one to another and secure to said second mounting surface through a plurality of mounting bracket receiving cavities, wherein said mounting brackets are positioned in an angular offset measured as an acute angle relative to said second mounting surface of about 30-60 degrees.

In one embodiment, the invention dividing panel has mounting structures that are mounting cavities formed within said dividing panel receive a display hook.

It is another object of this invention to provide a multifaceted merchandiser that is volumetrically efficient for carrying, transporting, and storage.

It is another object of this invention to provide a multifaceted merchandiser that can be readily assembled and disassembled without the need of any special tools.

It is another object of this invention to provide a multifaceted merchandiser, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
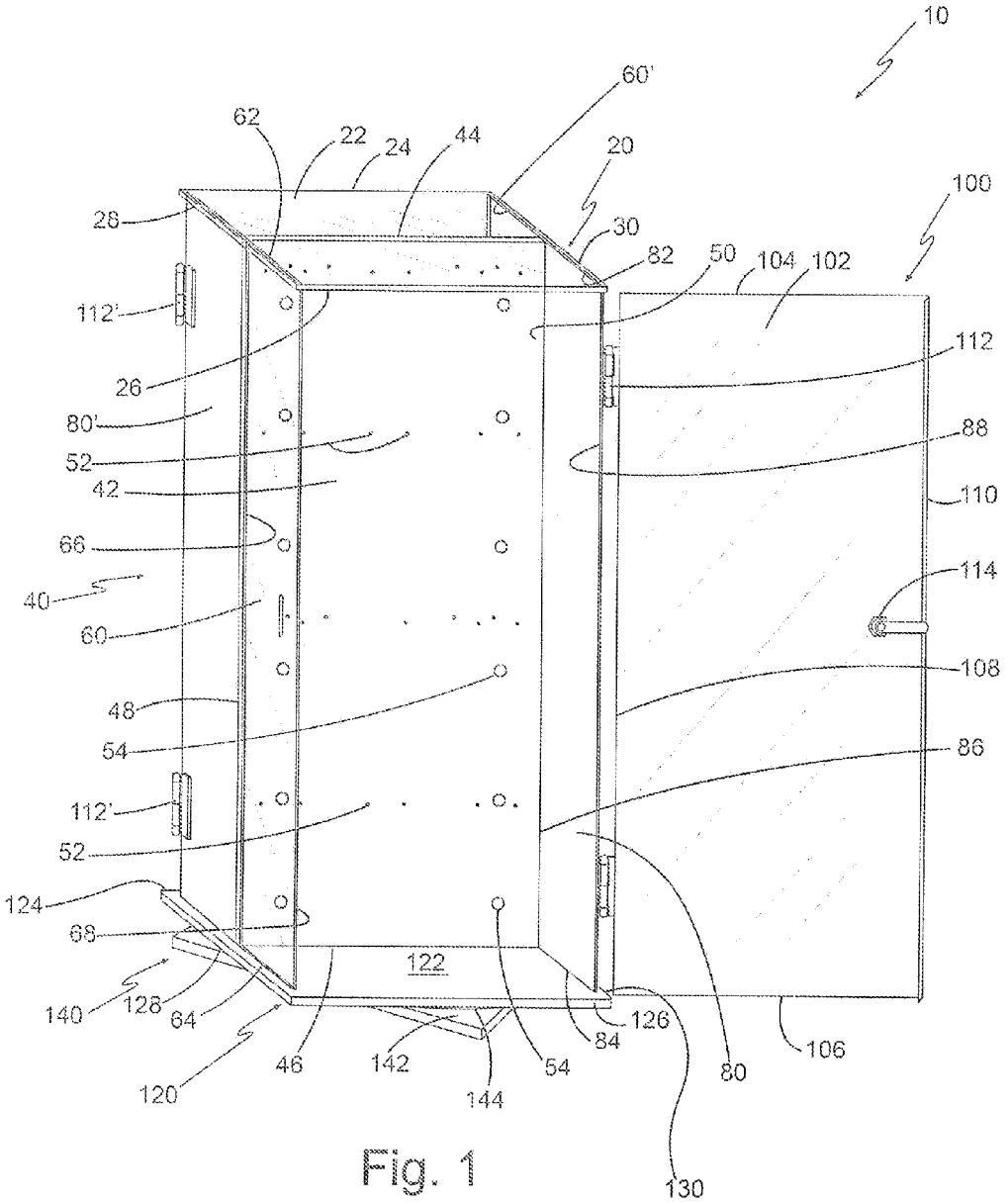
FIG. 1 represents a first front isometric view of a multifaceted merchandiser.

Referring now to the drawings, the present invention is generally referred to as a container assembly with numeral 10. It can be observed that it basically includes transparent top wall assembly 20, housing 40, and container base assembly 140.

Figure 5:
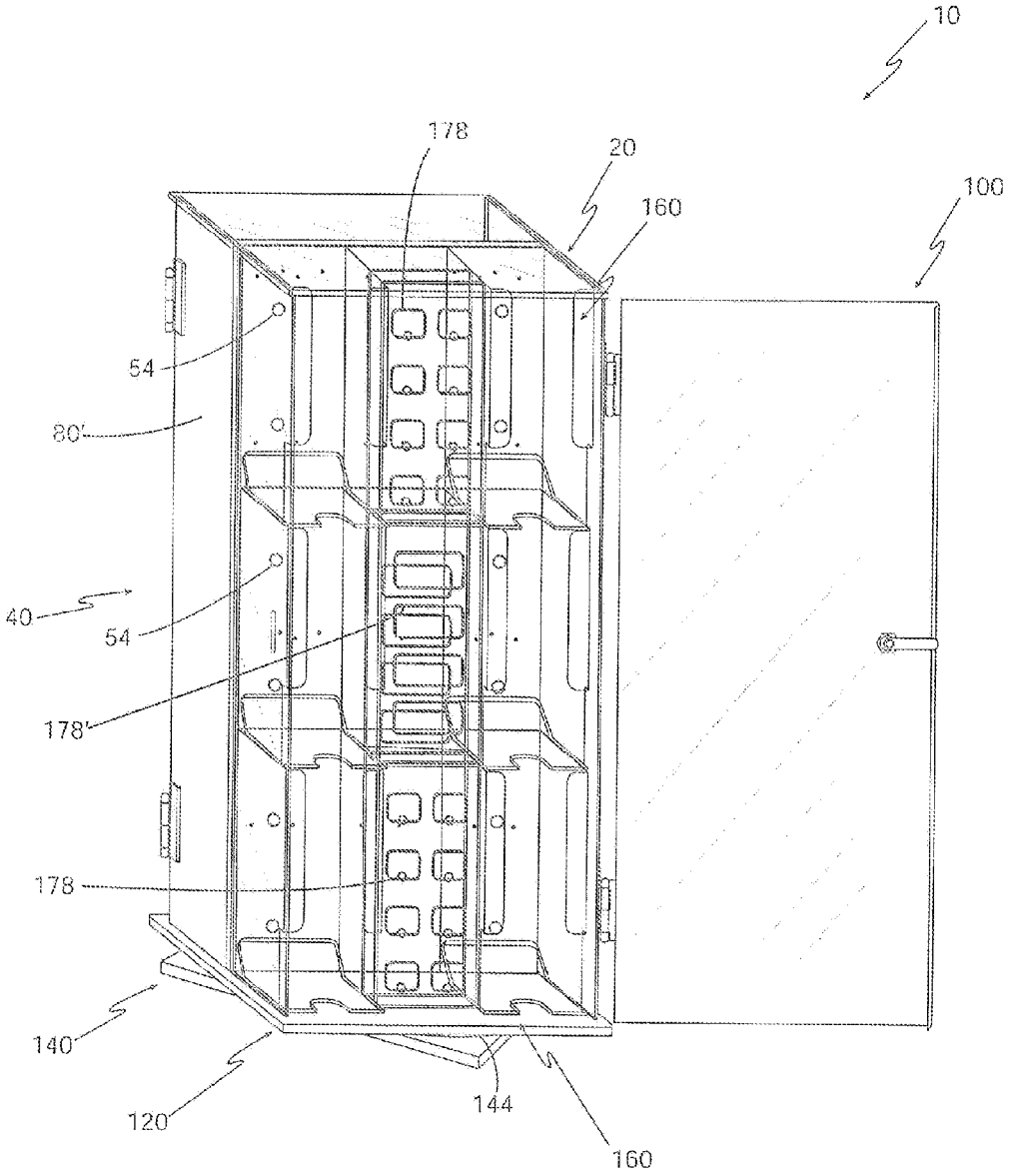
FIG. 5 is a second front isometric view of the present invention housing the first and second embodiment removable bins seen in FIGS. 2A and 3A respectively.
Figure 6:
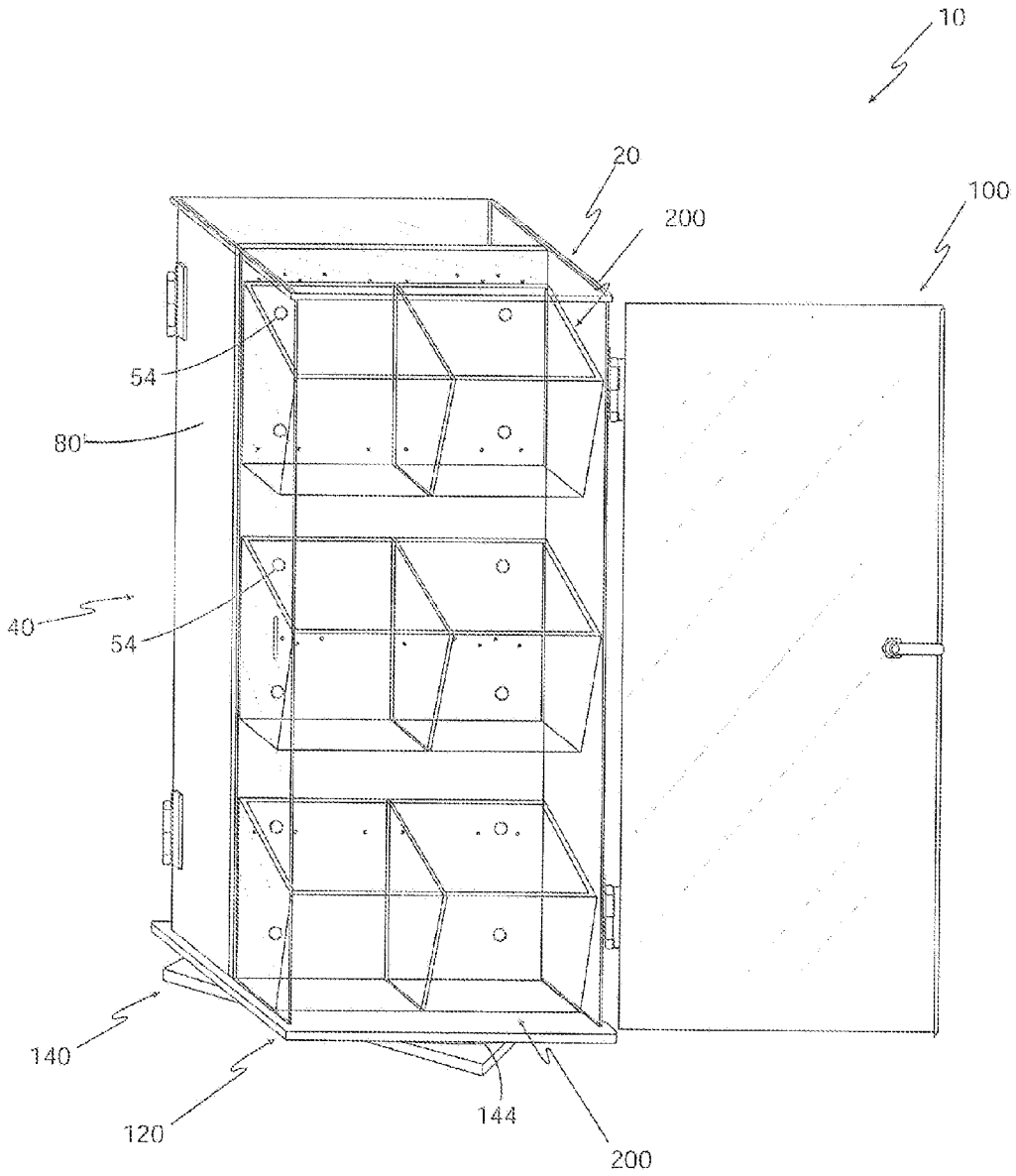
FIG. 6 is a third front isometric view of the present invention housing the third embodiment removable bin seen in FIG. 4A.

In one embodiment, container assembly 10, as best shown in FIGS. 1, 5, and 6, transparent top wall assembly 20 comprises top wall 22 having edges 24, 26, 28, and 30.

Housing 40 includes first front side panel 60, comprising edges 62, 64, 66, and 68. Container assembly 10 further includes a dividing panel first mounting face 42.

First front side wall panel 80 is defined by boundaries that are edges 82, 84, 86, and 88.

Door assembly 100, comprising door 102, is defined by boundaries that are edges 104, 106, 108, and 110; and in one embodiment, first door hinges 112.

Base wall assembly 120 comprises base wall 122 having edges 124, 126, 128, and 130, said base wall 122 forming an interior floor of container assembly 10.

Container assembly 10 is constructed and arranged with container base assembly 140. In one embodiment, container base assembly 140 is a swivel assembly that comprises swivel base 142 having swivel structure 144.

Container assembly 10 is further formed in one embodiment, of first front side panel 60 and first front side wall panel 80. Container assembly 10 is further formed in another embodiment, of first front side panel 60' and second front side wall panel 80'. First front side panel 60 includes first side panel lower edge 64, first side panel dividing panel interface edge 66, first side panel leading edge 68. Container assembly 10 side panel assemblies including first front side panel 60 and first front side wall panel 80, or first front side panel 60'. Dividing panel first mounting face 42 has formed thereon mounting cavities 52, and has attached hereto magnets 54.

Figure 7:
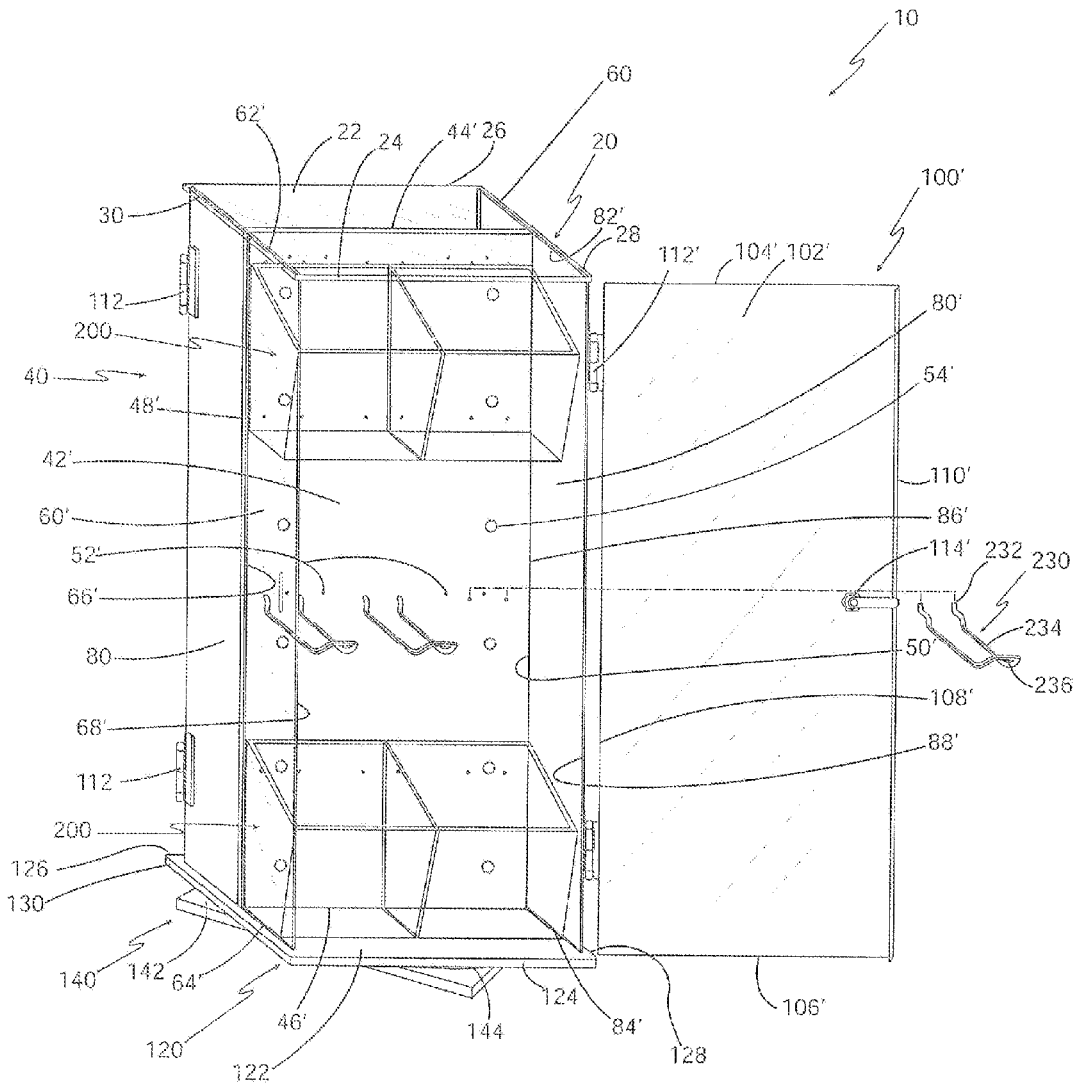
FIG. 7 represents a rear isometric view of the present invention housing the third embodiment removable bin seen in FIG. 4A and rail assemblies.

As seen in FIG. 7, container assembly 10 is constructed with first front side panel 60' defined by boundaries that are edges 62', 64', 66', and 68', and dividing panel second mounting face 42'. In this embodiment, second front side panel 80' is defined by boundaries that are edges 82', 84', 86', and 88'. In one embodiment, second door assembly 100' is a transparent door assembly and comprises door 102', defined by boundaries that are edges 104', 106', 108', and 110'; having second door hinges 112'.

First front side wall panel 80 includes edges 82 with front lid. Container assembly 10 further includes door assembly 100, having door 102. In one embodiment, door 102 having upper edge 104, door panel lower edge 106, door panel hinge side edge 108, and door panel opening edge 110. Door assembly 100 has at least two first door hinges 112, and optionally includes door assembly lock 114. Container assembly 10 further includes at least two second door hinges 112'.

Container assembly 10 is formed with base wall 122, said base wall forming an interior floor of container assembly 10. In one embodiment, base wall 122 is defined by container base rear edge 124, container base front edge 126, container base first base edge 128, and container base second base edge 130. Container assembly 10 further has a container base assembly 140. In one embodiment, container base assembly 140 is a swivel assembly that includes a container base 142 and a container base swivel 144.

In one embodiment of the present invention, as demonstrated in FIGS. 2A, 2B, 3A, and 3B, a bin assembly 160 provides for storage capabilities in one embodiment of the invention of container assembly 10. Bin assembly 160 has bin assembly rear panel 162, bin assembly rear panel upper edge 164, bin assembly rear panel lower edge 166, bin assembly first side panel 168, and bin assembly second side panel 170. Also formed in the present invention are structures as demonstrated in the figures, being an outer retaining wall 172, and an inner retaining wall 174. Bin assembly 160 further has a bin assembly first center panel 176 that has formed therein bin assembly first center panel cavities 178. Bin assembly 160 further includes bin assembly second center panel 182, having formed thereon bin assembly second center panel mounting cavities 180. Bin assembly 160 is constructed and arranged with a bin center section first side 184, a bin center section second side 186, bin assembly cavity floors 188, and bin assembly mounting ferrous objects 190 that mount upon at least one magnet 54.

Figure 4A:
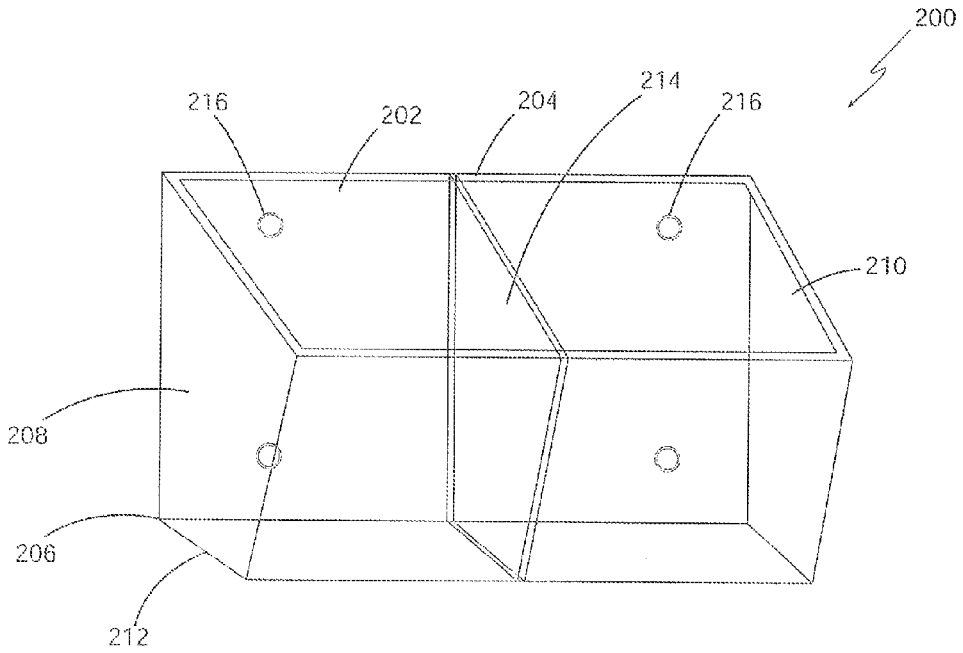
FIG. 4A is an isometric view of a third embodiment removable bin.
Figure 4B:
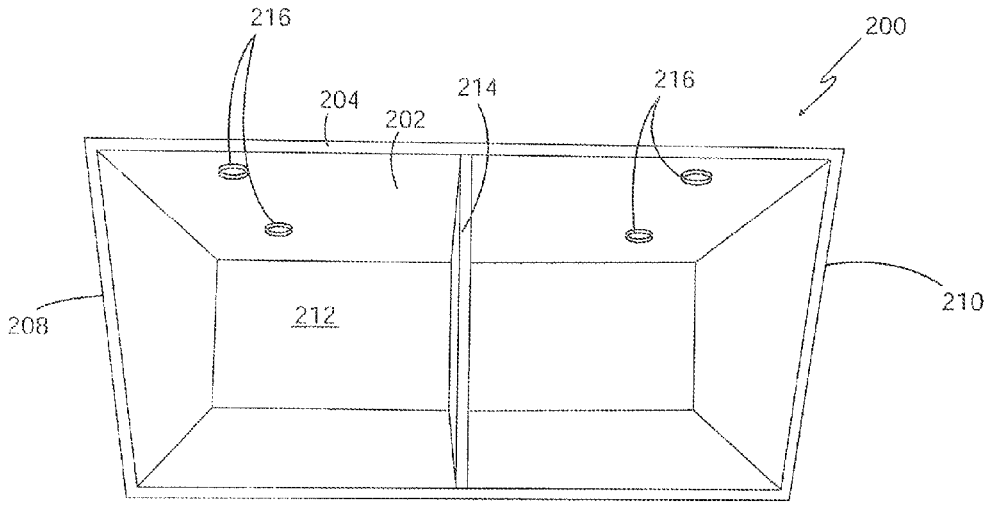
FIG. 4B is a top perspective view of the third embodiment removable bin seen in FIG. 4A.

As demonstrated in FIGS. 4A and 4B, container assembly 10 includes a second bin assembly 200, whereby second bin assembly 200 is formed of second bin assembly rear panel 202, second bin assembly upper edge 204, second bin assembly lower edge 206, second bin assembly first side panel 208, and second bin assembly second side panel 210. Second bin assembly 200 further includes second bin assembly floor 212, second bin assembly central dividing panel 214, and second bin assembly mounting ferrous objects 216 that mount upon at least one magnet 54.

FIG. 5 is demonstrative of an embodiment where bin assembly 160 is incorporated into container assembly 10.

FIG. 6 is an embodiment demonstrating second bin assembly 200 incorporated into container assembly 10.

As seen in FIG. 7, container assembly 10 is constructed with first front side panel 60' defined by boundaries that are edges 62', 64', 66', and 68', mounting face 42'. In this embodiment, second front side panel 80' is defined by boundaries that are edges 82', 84', 86', and 88'. Second door assembly 100' comprises door 102', defined by boundaries that are edges 104', 106', 108', and 110'; having second door hinges 112'.

Further contemplated in the present invention is an embodiment as demonstrated in FIG. 7, whereby hanging mounting assembly 230 includes an apparatus body 234, an apparatus distal end 236, and an apparatus mounting end 232 that is constructed and arranged to mount into dividing panel first mounting face 42 through mounting cavities 52. In one embodiment, each mounting assembly 230 is perpendicular to dividing panel first mounting face 42. In another embodiment, each mounting assembly 230 is parallel one to the other and positioned in an angular offset relative to dividing panel first mounting face 42. In one embodiment, the angular offset is measured as an acute angle relative to the plane defined by dividing panel first mounting face 42. In one embodiment, the angular offset is between about 20-70 degrees. In another embodiment, the angular offset is between about 30-60 degrees.

As generally understood, a user will be provided with container assembly 10, in which no secondary bin assemblies are provided. The user will select at least one desired bin assembly and secure it to container assembly 10 as demonstrated by the figures. The user will then be able to store articles in container assembly 10 by accessing the interior of container assembly 10 through door assembly 100. As desired, a user will close door assembly 100 and secure it into a fixed and closed position using door assembly lock 114.

Component panels of the present invention are transparent, translucent, opaque, or combinations thereof.

Figure 2A:
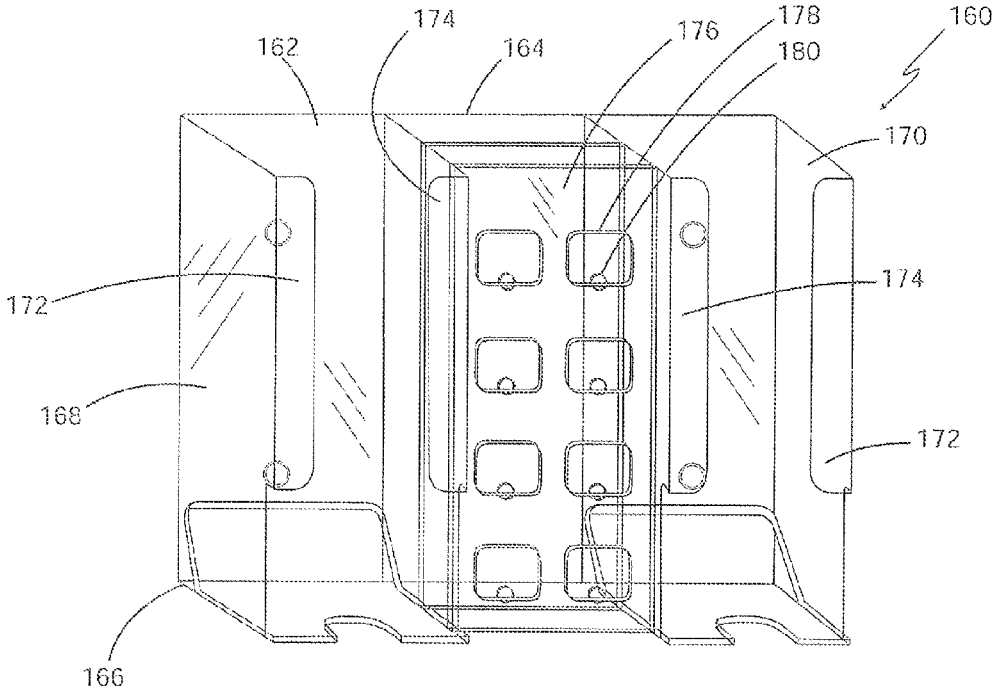
FIG. 2A is an isometric view of a first embodiment removable bin.
Figure 2B:
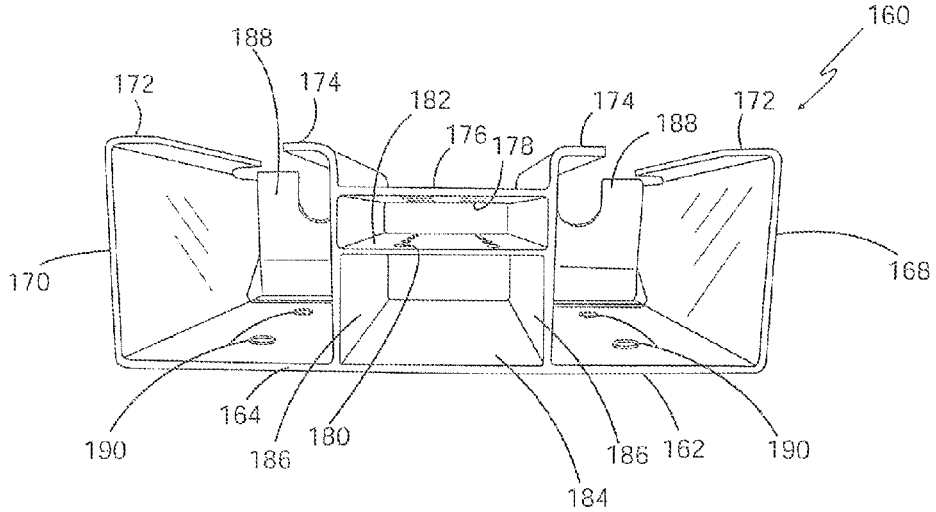
FIG. 2B is a top perspective view of the first embodiment removable bin seen in FIG. 2A.
Figure 3A:
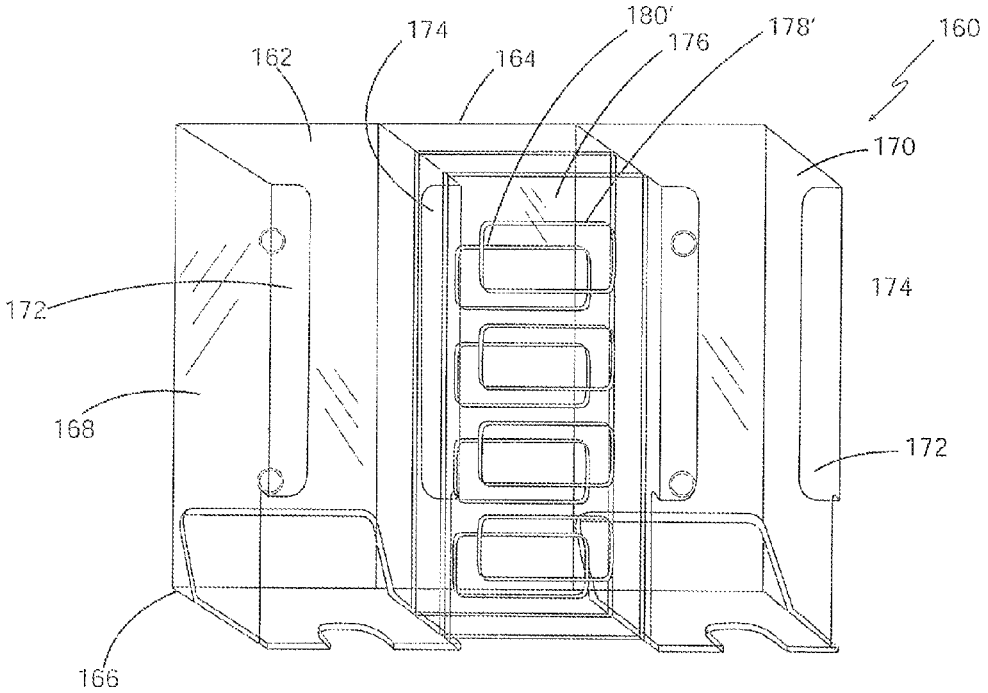
FIG. 3A is an isometric view of a second embodiment removable bin.
Figure 3B:
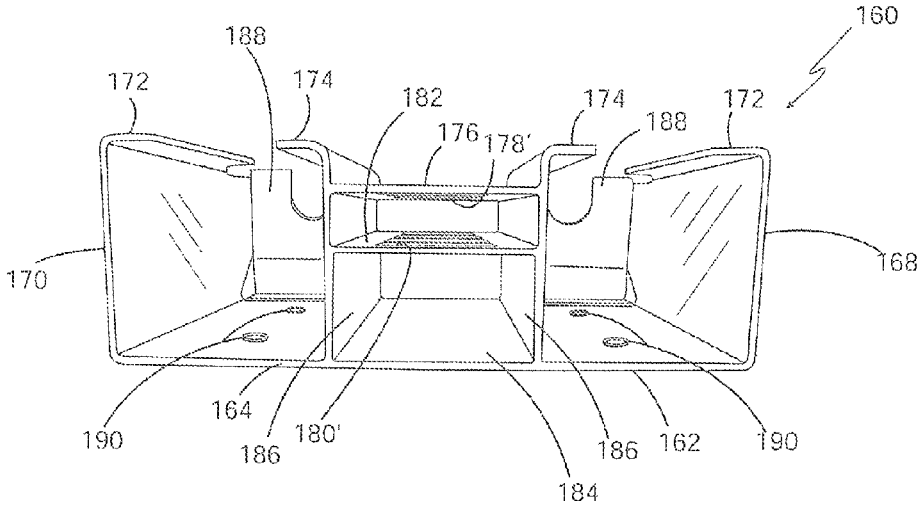
FIG. 3B is a top perspective view of the second embodiment removable bin seen in FIG. 3A.

In use, a particular configuration is assembled and interior bins are selected and secured into position. In FIG. 2A, bin assembly first center panel cavities 178, and FIG. 3A, second bin assembly center panel cavities 178' and second bin assembly center panel mounting cavities 180', are constructed and arranged for openings to receive and display merchandise therein including, but not limited to, cell phone accessories/chargers, etc.

In one embodiment, viewing from above top wall assembly 20, container assembly 10 is formed like a letter "I" in which either of dividing/mounting panels 42 and 42 form a single wall.

The present invention provides dividing panels 42 and 42° with mounting faces positioned in the direction of the door, whereby the mounting faces have the aforementioned mounting cavities 52, and magnets 54, enable a user to accommodate different types of bins and/or hooks depending on desired displays.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A multifaceted merchandiser, comprising:

A) a body having an internal cavity and formed of a first plurality of body panels that are a combination of transparent and translucent panels;

B) a door for accessing said internal cavity;

C) a dividing panel formed with a first mounting surface facing towards said door;

D) mounting structures associated with said first mounting surface, said mounting structures constructed and arranged as mounting magnets for affixing articles thereto and mounting cavities constructed and arranged for receiving a display hook; and E) at least one bin having at least one magnetic material attached or associated therewith that is magnetically attracted to said mounting magnets for removably mounting on said dividing panel, said at least one bin comprising a rear panel, a bin assembly rear panel upper edge, a bin assembly rear panel lower edge, a bin assembly first side panel, and a bin assembly second side panel, said at least one bin further comprising inner and outer retaining walls, said at least one bin further comprising first and second central panels each parallel to the rear panel, said second central panel being between the rear panel and the first central panel, said second central panel having cavities formed therein.

2. The multifaceted merchandiser set forth in claim 1, further characterized in that said body is formed of a second plurality of body panels that are a combination of transparent and opaque panels.

3. The multifaceted merchandiser set forth in claim 1, further characterized in that said mounting cavities are formed within said dividing panel.

4. The multifaceted merchandiser set forth in claim 1, wherein said at least one magnetic material includes at least one metallic or ferrometallic material to mount said at least one bin onto respective said mounting magnets.

5. The multifaceted merchandiser set forth in claim 1, wherein said at least one magnetic material includes at least one ferrous material to mount said at least one bin onto respective said mounting magnets.

6. The multifaceted merchandiser set forth in claim 1, further characterized in that said door is hingedly attached to the multifaceted merchandiser with a conventional hinge.

7. The multifaceted merchandiser set forth in claim 1, further characterized in that said door includes a lock.

8. The multifaceted merchandiser set forth in claim 1, further including a swivel assembly positioned under said body.

9. The multifaceted merchandiser set forth in claim 1, further including a second door, a second mounting surface facing said second door, a pair of hanging mounting assembly constructed and arranged to mount parallel one to another and secure to said second mounting surface through a plurality of said mounting cavities.

10. The multifaceted merchandiser set forth in claim 1, further including a second door, a second mounting surface facing said second door, a pair of hanging mounting assembly constructed and arranged to mount parallel one to another.

11. The multifaceted merchandiser set forth in claim 1, wherein said first center panel has formed therein bin assembly first center panel cavities.

12. The multifaceted merchandiser set forth in claim 11, wherein said at least one bin is constructed and arranged with a bin center section first side, first and second bin center section sides, and bin assembly cavity floors.

* * * * *